United States Patent [19]

Weimer

[11] 4,000,844

[45] Jan. 4, 1977

[54] ONE-PIECE PARTITION

[75] Inventor: Charles Perry Weimer, Plainfield, Conn.

[73] Assignee: International Paper Company, New York, N.Y.

[22] Filed: Oct. 30, 1975

[21] Appl. No.: 627,135

[52] U.S. Cl. ..... 229/15; 229/28 R; 229/42

[51] Int. Cl.[2] ..... B65D 5/48

[58] Field of Search ..... 229/15, 89, 28, 42

[56] References Cited

UNITED STATES PATENTS

| | | | |
|---|---|---|---|
| 1,551,139 | 8/1925 | Dietsche, Jr. | 229/15 |
| 2,473,766 | 6/1949 | Richey | 229/42 |
| 2,596,205 | 5/1952 | Buttery | 229/28 R |
| 2,693,308 | 11/1954 | Giroux et al. | 229/28 R |
| 2,693,309 | 11/1954 | Giroux et al. | 229/28 R |
| 2,698,708 | 1/1955 | Margolies | 229/28 R |
| 2,710,130 | 6/1955 | Grecco | 229/15 |
| 2,958,452 | 11/1960 | Kuchenbecker | 229/15 |
| 3,014,632 | 12/1961 | Kuchenbecker | 229/15 |
| 3,626,494 | 12/1971 | Levin | 229/15 |
| 3,749,299 | 7/1973 | Ingle | 229/15 |
| 3,921,891 | 11/1975 | Gorham | 229/15 |

*Primary Examiner*—Davis T. Moorhead
*Attorney, Agent, or Firm*—Ronald A. Schapira

[57] ABSTRACT

A one-piece paperboard partition and a die cut blank for forming it. The blank includes a rectangular panel made up of one set of two rectangular flaps or one or more sets of three rectangular flaps. The sets of flaps and the flaps in each set of the panel are arranged in a row and are foldably connected along one or more fold lines. Each set of flaps consists of one inner flap and one or two outer flaps. Each outer flap in a set includes a continuous slot, extending from the same side of its set of flaps and parallel to the fold lines. The blank also includes one or more bridging members, each of which is foldably connected to an inner flap, along the one slotted side of the set of flaps to which the bridging member is connected. The blank further includes one or more rectangular forked panels, each of which is foldably connected to the opposite side of a bridging member, remote from the one slotted side of the set of flaps to which the bridging member is attached. Each forked panel has one or more continuous slots extending from a side thereof, remote from the one slotted side of the adjacent set of flaps. The center line of a slot in each forked panel is colinear with a fold line between an inner flap and an outer flap. Also, the length of each bridging member, between an inner flap and a forked panel, equals the distance between the center line of the slot in an outer flap and the adjacent fold line between the inner flap and the outer flap. The panel, forked panels and bridging members are adapted to be folded, to form the partition, so that: the forked panels are transverse to the outer flaps; the flaps and forked panels are in an upstanding position; and the center line of the slot in each outer flap is vertical and colinear with a slot in a forked panel.

28 Claims, 14 Drawing Figures

FIG. 4
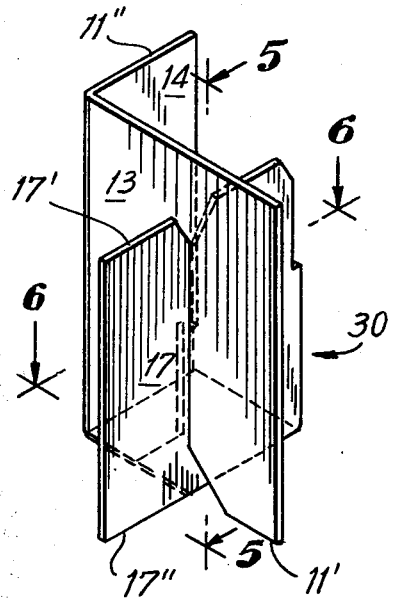
FIG. 5
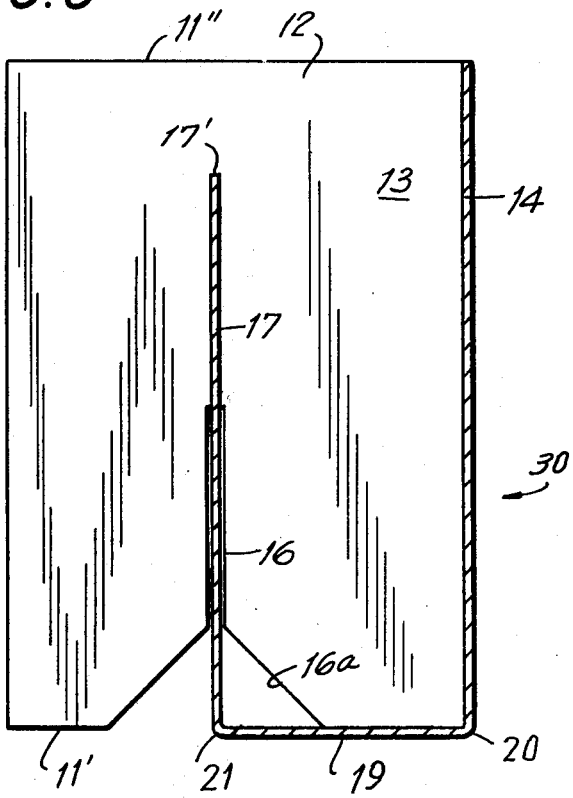
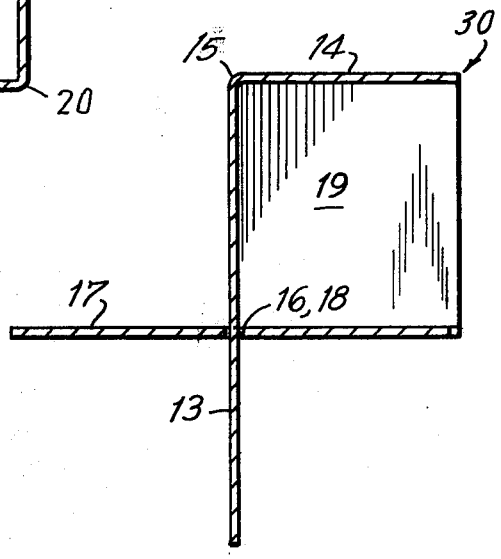
FIG. 6

ONE-PIECE PARTITION

BACKGROUND OF THE INVENTION

This invention relates to a one-piece, paperboard partition for separating and shielding a plurality of items, such as bottles, in a packing or shipping container. This invention particularly relates to a one-piece partition which can be quickly and easily assembled by a single workman, which is relatively rigid and strong, and which require only relatively small amounts of paperboard material.

Paperboard partitions are well known in the prior art. See, for example, U.S. Pat. Nos. 1,551,139, 2,473,766, 2,693,308, 2,710,130, and 2,958,452. However, the heretofore available partitions generally have had one or more undesirable features. For example, many partitions have had relatively complicated structures, e.g., the partitions in U.S. Pat. Nos. 1,551,139, 2,693,308, 2,693,309, 2,698,708, and 3,749,299. This has made such partitions difficult to assemble. Other partitions have required the use of two or more, separate pieces for their construction, e.g., the partitions in U.S. Pat. Nos. 2,473,766, 2,698,708 and 3,749,299. This has made such partitions difficult to assemble and, often, somewhat wasteful of paperboard material. Still other partitions have required the use of multiple, folded-over thicknesses of paperboard material in their construction, e.g., the partitions in U.S. Pat. Nos. 2,710,130, 2,958,452 and 3,014,632. This has made such partitions relatively wasteful of paperboard material.

SUMMARY OF THE INVENTION

In accordance with this invention, a one-piece blank for a partition is provided which comprises:

a panel having a set of two substantially rectangular flaps arranged in a row; said flaps of said panel being foldably connected along a fold line between said flaps;

a continuous slot being provided in an outer flap of said set of flaps of said panel, extending from one side of said set of flaps and parallel to said fold line;

a bridging member, one side of which is foldably connected only to an inner flap of said set of flaps along said one slotted side of said set of flaps; and a forked panel, foldably connected to the opposite side of said bridging member, remote from said one slotted side of said set of flaps, and having a continuous slot extending from a side thereof remote from said one slotted side of said set of flaps;

the center line of said slot in said forked panel being substantially colinear with said fold line between said inner and outer flaps of said set of flaps, and the length of said bridging member, between said forked panel and said inner flap, being about equal to the distance between the center line of said slot in said outer flap and the adjacent fold line between said inner and outer flaps in said set of flaps in said panel.

Also in accordance with this invention, a one-piece partition is provided, which comprises:

an upstanding forked panel, having a vertical continuous slot extending from the top side thereof;

an upstanding, substantially rectangular flap, having a vertical continuous slot extending from the bottom side thereof;

an upstanding, substantially rectangular side wall flap, foldably connected to an upstanding side of said flap; and a bridging member, foldably connected to the bottom side of said wall flap and to the bottom side of said forked panel;

said flap being transverse to said forked panel and the center lines of said slots in said flap and in said forked panel being substantially colinear.

The one-piece blank and the partition formed from the blank provide a paperboard construction that is useful for separating containers, particularly filled containers, in packing cartons. The partition has the advantages of being easily formed from the blank by a single workman, being relatively strong and rigid, and requiring only a relatively small amount of paperboard material in its construction.

BRIEF DESCRIPTION OF THE DRAWINGS

FIG. 4 is a perspective view of a fully assembled, four-cell partition, in accordance with this invention, formed from the partially assembled partition of FIG. 3.

FIG. 5 is a sectional view taken along line 5—5 in FIG. 4.

FIG. 6 is a sectional view taken along line 6—6 in FIG. 4.

DETAILED DESCRIPTION OF THE INVENTION

Figure 1:
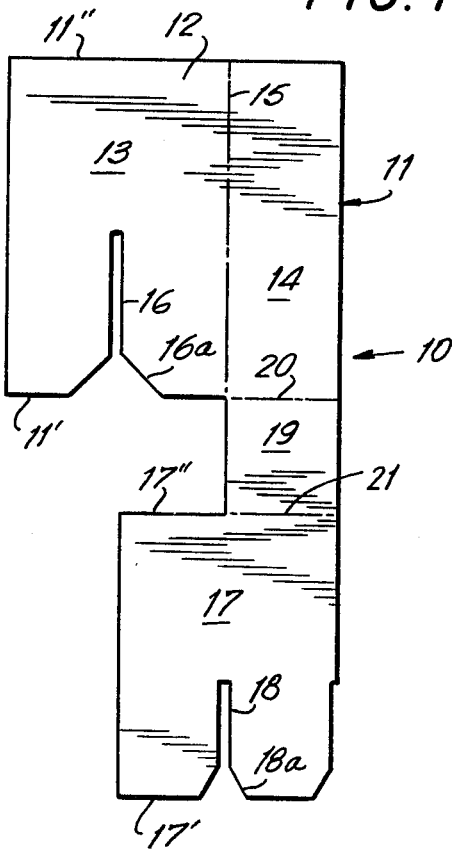
FIG. 1 is a plan view of a paperboard blank, in accordance with this invention, for forming a four-cell partition.

Shown in FIG. 1 is a one-piece paperboard blank, generally 10, in accordance with this invention. The blank 10 is adapted to be folded into a one-piece, four-cell partition, generally 30, shown in FIG. 4.

As seen from FIG. 1, the blank 10 includes a substantially rectangular panel, generally 11. The panel 11 consists of one set 12 of two foldably connected, substantially rectangular flaps 13 and 14. In the set 12, one of the two flaps is an outer flap 13, and the other of the two flaps is an inner flap 14. The inner and outer flaps 13 and 14 are arranged in a row and are foldably connected along a fold line 15. Preferably, the fold line 15 is a scored fold line. The lengths of the flaps 13 and 14, as measured along the fold line 15, preferably, are approximately equal. However, the widths of the flaps 13 and 14 differ in a manner which will hereinafter be discussed.

Provided in the outer flap 13 and preferably not provided in the inner flap 14 is a continuous slot 16. The slot 16 in the outer flap 13 extends from one side or edge 11' of the panel 11 and the set 12 of flaps 13 and 14. The slot 16 is substantially parallel to the fold line 15. The width of the slot 16 preferably is equal to or greater than the thickness of the blank 10. In this regard, it is especially preferred that the width of the slot 16 at the one slotted side 11' of the panel 11 be much larger than the width of the remainder of the slot. For this purpose, angle-cut notches **16*a* are cut into the one slotted panel side 11'. The notch 16*a* intersects the slot 16 and preferably is located between the slot 16 and the inner flap 14**.

The blank 10 also includes a substantially rectangular, forked panel 17. The forked panel 17 includes at least one continuous slot 18 extending from one side or edge 17' of the forked panel 17 remote from the one slotted panel side 11'. The width of the forked panel slot 18 preferably is equal to or greater than the thickness of the blank 10. In this regard, it is especially preferred that the width of the forked panel slot 18 along the one slotted side 17' of the forked panel 17 be much larger than the width of the remainder of the slot 18. For this purpose, a notch **18*a* is cut into the one slotted side 17' of the forked panel 17 about the center line of the forked panel slot 18**.

The blank 10 further includes a bridging member 19. One side of the bridging member 19 is foldably connected along a first fold line 20 to the panel 11 and to the inner flap 14 of the set 12 of two flaps 13 and 14 in the panel 11. The opposite side of the bridging member 19 is foldably connected to the forked panel 17 along a second fold line 21. Fold lines 20 and 21 are substantially parallel and are preferably scored fold lines. The bridging member 19 is foldably connected to the panel 11 and to the inner flap 14 along the one slotted panel side 11'. The bridging member 19 is foldably connected to the forked panel 17 along a second side 17'' of the forked panel 17. The second forked panel side 17'' is the side of the forked panel 17 located closest to the one slotted panel side 11' and on the opposite side of the forked panel 17 from the one slotted forked panel side 17'.

In blank 10 of this application, it is considered essential that the center line of the slot 18 in the forked panel 17 be substantially aligned with the fold line 15, in the panel 11, between the inner flap 14 and the outer flap 13. It is also considered essential in blank 10 that the first bridging member fold line 20 not extend beyond fold line 15. However, the location and length of the first bridging member fold line 20 are otherwise not critical. In fact, the first bridging member fold line 20 can suitably be located anywhere along the portion of the one slotted panel side 11' bounding the inner flap 14 and can suitably have a length equal to or less than the width of the inner flap 14, as measured transverse of fold line 15. Preferably, the length of the first bridging member fold line 20 equals the width of the inner flap 14.

Also in blank 10, the second bridging member fold line 21, connecting bridging member 19 and forked panel 17, is located along the second forked panel side 17''. However, the location and length of the second bridging member fold line 21 are not critical. In fact, the second bridging member fold line 21 can suitably lie anywhere along the second forked panel side 17'' and have a length that is less than, equal to, or greater than the length of the first bridging member fold line 20. Preferably, the second bridging member fold line 21 has about the same length as the first bridging member fold line 20.

Further in blank 10, the length of the bridging member 19, as measured by the distance between the inner flap 14, to which it is attached, and the forked panel 17, must be substantially equal to the distance between the center line of the slot 16 in outer flap 13 and the adjacent fold line 15, between inner and outer flaps 13 and 14.

Except as otherwise stated above, the shape and size of the bridging member 19 of this application are not considered critical. In fact the bridging member can have any configuration which does not interfere with the formation of a partition 30 from the forked panel 17 and the rectangular panel 11. Preferably, the bridging member 19 is substantially rectangular, having a width, as measured along bridging member fold lines 20 and 21, equal to or less then, preferably equal to, the width of the inner flap 14. In the especially preferred blank 10 of this application, bridging member 19 is substantially square, and both the distance between bridging member fold lines 20 and 21 and the lengths of bridging member fold lines 20 and 21 equal the distance between the fold line 15 and the center line of the slot 16 in the outer flap 13. In the particularly preferred blank 10, bridging member 19 is square, and the distance between fold line 15 and the center line of the slot 16 in the outer flap 13 equals the distance between fold line 15 and the opposite edge 14a of the inner flap 14. As a result, the lengths of the bridging member fold lines 20 and 21 and the distance between them each equals the width of the inner flap 14, to which the bridging member 19 is connected.

In blank 10, the widths of the two flaps 13 and 14, as measured transverse of fold line 15, are not critical. Preferably, the outer flap 13, which contains the slot 16, is twice as wide as the inner flap 14, and the slot 16 is located in the width-wise middle of the outer flap 13. In this way, a partition 30 can be formed having four substantially square cells formed by the substantially rectangular flaps 13 and 14 and the forked panel 17 of the blank 10.

Also in blank 10, the lengths of the flap slot 16 and forked panel slot 18 are not critical. Preferably, the combined length of the flap slot 16 and the forked panel slot 18 is about equal to the width of the shorter of: the forked panel 17, as measured between the opposite forked panel sides 17' and 17''; and the rectangular panel 11, as measured between its opposite sides 11' and 11''. It is particularly preferred that the flap slot 16 and the forked panel slot 18 be of about equal length and have a combined length equal to the width of the forked panel 17, between its opposite sides 17' and 17''.

As seen from the foregoing, the blank 10 of this application basically comprises: a panel 11 having a set 12 of two substantially rectangular flaps 13 and 14 arranged in a row; the flaps 13 and 14 of the panel 11 being foldably connected along a fold line 15 between the flaps; a continuous slot 16 being provided in an outer flap 13 of the set 12 of flaps 13 and 14 of the panel 11, extending from one side 11' of the set of flaps and parallel to the fold line 15; a bridging member 19, one side of which is foldably connected only to an inner flap 14 (along fold line 20) of the set 12 of flaps 13 and 14 along the one slotted side 11' of the set of flaps; and a forked panel 17, foldably connected to the opposite side of the bridging member 19 (along fold line 21), remote from the one slotted side 11' of the set of flaps, and having a continuous slot 18 extending from a side 17' thereof remote from the one slotted side 11' of the set of flaps; the center line of the slot 18 in the forked panel 17 being substantially colinear with the fold line 15 between the inner and outer flaps 13 and 14 of the set 12 of flaps, and the length of the bridging member 19, between the forked panel 17 and the inner flap 14, being about equal to the distance between the center line of the slot 16 in the outer flap 13 and the adjacent fold line 15 between the inner and outer flaps 13 and 14 in the set 12 of flaps in the panel 11.

Figure 2:
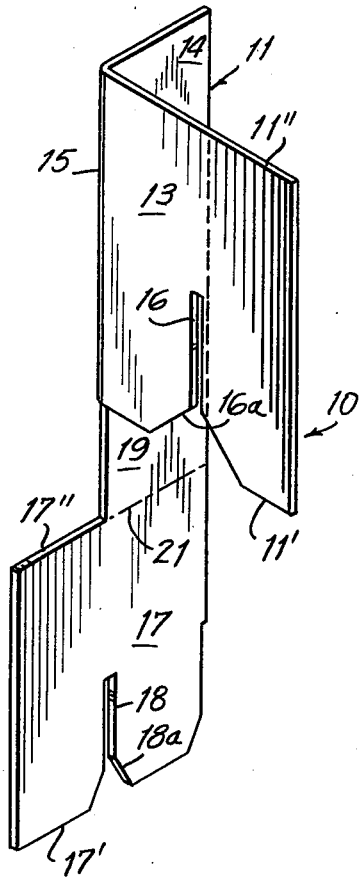
FIG. 2 is a perspective view of a partially assembled partition, formed from the blank of FIG. 1.

Shown in FIG. 2 is a first step in folding the blank 10 into the one-piece partition 30. In FIG. 2, the outer flap 13 of the set 12 of flaps 13 and 14 in panel 11 has been folded about fold line 15 to form an L-shaped construction. In this L-shaped construction, as seen in FIGS. 2–6, the outer flap 13 is substantially perpendicular to the inner flap 14 of panel 11. Also in this L-shaped construction, the inner flap 14 and outer flap 13 of set 12 are perpendicular to the plane defined by the one slotted side 11' of panel 11, as folded, and, hence, respectively comprise an upstanding, substantially rectangular side wall flap 14 and an upstanding, substantially rectangular flap 13.

Figure 3:
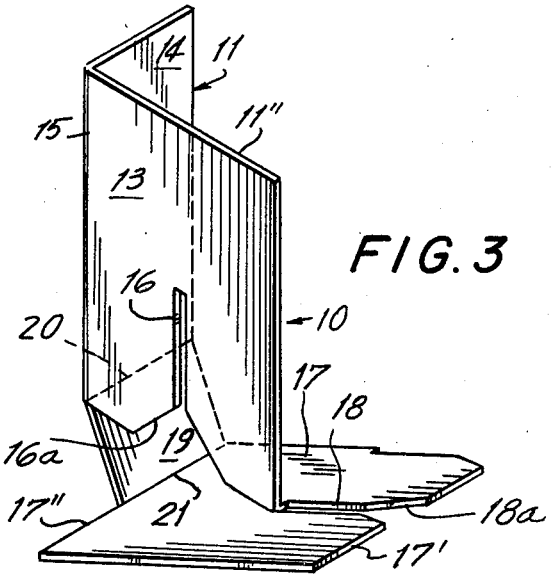
FIG. 3 is a perspective view of a partially assembled partition, formed from the partially assembled partition shown in FIG. 2.

Shown in FIG. 3 is a second step in folding the blank 10 to form the one-piece partition 30. As seen in FIG. 3, the bridging member 19 and the forked panel 17 have been folded somewhat about the bridging member fold lines 20 and 21. As folded, the forked panel slot 18 is adjacent to the slotted side 11' of the upstanding flap 13.

Shown in FIG. 4 is the assembled partition 30, formed from the blank 10, as folded through the steps shown in FIGS. 2 and 3. The partition has been completed by folding the forked panel 17 and bridging member 19 further about bridging member fold lines 20 and 21. In the partition 30, the forked panel 17 is perpendicular to the plane formed by the one slotted side 11' of panel 11, as folded. As a result, the center line of the forked panel slot 18 is colinear with the center line of the flap slot 16, and both slots 16 and 18 are perpendicular to the plane defined by the one slotted side 11' of panel 11, as folded. Also in the partition 30, the forked panel 17 is substantially tansverse to the flap 13 and parallel to the side wall flap 14. Further in partition 30, bridging member 19 is substantially horizontal and coplanar with the one slotted panel side 11'.

As erected from the blank 10, the partition 30 of FIG. 4 basically comprises: an upstanding forked panel 17, having a vertical continuous slot 18 extending from the top side 17'thereof; an upstanding, substantially rectangular flap 13, having a vertical continuous slot 16 extending from the bottom side 11' thereof; an upstanding, substantially rectangular side wall flap 14, foldably connected to an upstanding side (along fold line 15) of the flap 13; and a bridging member 19, foldably connected to the bottom side 11' of the side wall flap 14 and to the bottom side 17'' of the forked panel 17; the flap 13 being transverse to the forked panel 17 and the center lines of the slots 16 and 18 in the flap 13 and in the forked panel 17 being substantially colinear.

Figure 7:
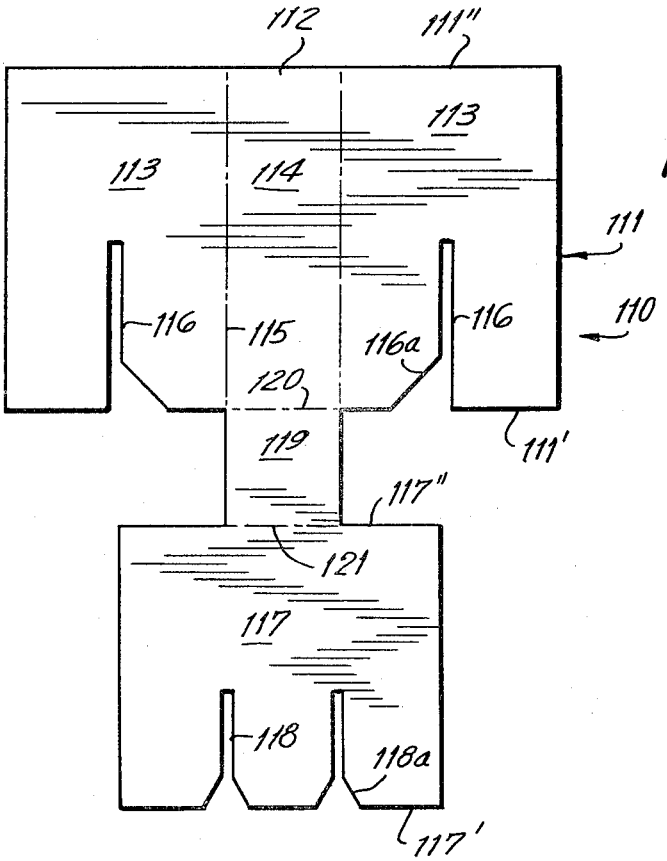
FIG. 7 is a plan view of a paperboard blank, in accordance with an alternative embodiment of this invention, for forming a six-cell partition.
Figure 8:
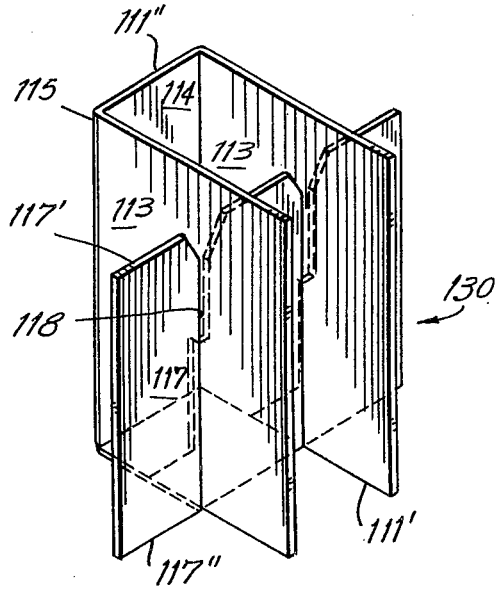
FIG. 8 is a perspective view of a fully assembled, six-cell partition, formed from the blank of FIG. 7.

Shown in FIG. 7 is a one-piece paperboard blank, generally 110. The blank 110 is adapted to be folded into a one-piece, six-cell partition, generally 130, shown in FIG. 8. The blank 110 and the partition 130 of FIGS. 7 and 8 are alternative embodiments of this invention and include elements corresponding in function and configuration to elements of the blank 10 and partition 30 of FIGS. 1 and 4. Hence, in describing this invention, elements of the blank 110 and partition 130 will have reference numerals which differ by one hundred (100) from the corresponding elements of the blank 10 and partition 30.

As seen from FIG. 7, the blank 110 includes a substantially rectangular panel, generally 111. The panel 111 consists of one set 112 of three foldably connected, substantially rectangular flaps 113, 113 and 114. In the set 112, two of the three flaps are outer flaps 113, and one of the three flaps is an inner flap 114, located between the two outer flaps 113. The three flaps 113, 113 and 114 are arranged in a row and are foldably connected along substantially parallel fold lines 115. Preferably, the parallel fold lines 115 are scored fold lines. The lengths of the flaps 113, 113 and 114, as measured along the fold lines 15, preferably are approximately equal. However, the widths of the flaps can differ in a manner which will hereinafter be discussed.

Provided in each of the outer flaps 113 and preferably not provided in the inner flap 114 is a continuous slot 116. The slots 116 in the outer flaps 113 extend from one side or edge 111' of the panel 111 and the set 112 of flaps 113, 113 and 114. The slots 116 are substantially parallel to the fold lines 115 and to each other. The widths of the slots 116 preferably are equal to or greater than the thickness of the blank 110. In this regard, it is especially preferred that the width of each slot 116 at the one slotted side 111' of the panel 111 be much larger than the width of the remainder of the slot. For this purpose, angle-cut notches **116*a* are cut into the one slotted panel side 111'. Each notch 116*a* intersects one of the slots 116 and preferably is located between the one slot 116 and the inner flap 114**.

The blank 110 also includes a substantially rectangular, forked panel 117. The forked panel 117 has at least two, preferably only two, substantially parallel, continuous slots 118 extending from one side or edge 117' of the forked panel 117 remote from the one slotted panel side 111'. The widths of the forked panel slots 118 preferably are equal to or greater than the thickness of the blank 110. In this regard, it is especially preferred that the width of each forked panel slot 118 along the one slotted side 117' of the forked panel 117 be much larger that the width of the remainder of the slot 118. For this purpose, notches **118*a* are cut into the one slotted side 117' of the forked panel 117 about the center lines of the forked panel slots 118**.

The blank 110 further includes a bridging member 119. One side of the bridging member 119 is foldably connected along a first fold line 120 to the panel 111 and to the inner flap 114 in the set 112 of three flaps 113, 113 and 114 in the panel 111. The opposite side of the bridging member 119 is foldably connected to the forked panel 117 along a second fold line 121. Fold lines 120 and 121 are substantially parallel and are preferably scored fold lines. The bridging member 119 is foldably connected to the panel 111 and to the inner flap 114 along the one slotted side 111' of the panel 111. The bridging member 119 is foldably connected to the forked panel 117 along a second side 117'' of the forked panel 117. The second forked panel side 117'' is the side of the forked panel 117 located closest to the one slotted panel side 111' and on the opposite side of the forked panel 117 from the one slotted forked panel side 117'.

In blank 110 of this application, it is considered essential that the center lines of the two slots 118 in the forked panel 117 be aligned with the fold lines 115, in the panel 111, about the inner flap 114, to which the bridging member 119 is attached along the first bridging member fold line 120. It is also considered essential in blank 110 that the first bridging member fold line 120 be located between the two fold lines 115 in panel 111. Hence, in FIG. 7, the first bridging member fold line 120 is between both the two fold lines 115, about the inner flap 114 in panel 111, and between the center lines of the two slots 118 in forked panel 117. However, the location and length of the first bridging member fold line 120 are otherwise not critical. In fact, the first bridging member fold line 120 can suitably be located anywhere between the fold lines 115 and can suitably have a length equal to or less than the width of the inner flap 114, i.e., the distance between the two fold lines 115. Preferably, the length of the first bridging member fold line 120 equals the width of the inner flap 114.

Also in blank 110, the second bridging member fold line 121, connecting bridging member 119 and forked panel 117, is located along the second forked panel side 117'' and between the two fold lines 115, about the inner flap 114. However, the location and length of the second bridging member fold line 121 are not critical. In fact, the second bridging member fold line 121 can suitably lie anywhere along the second forked panel side 117'' and have a length that is less than, equal to, or greater than the length of the first bridging member fold line 120. Preferably, the second bridging member fold line 121 has about the same length as the first bridging member fold line 120.

Further in blank 10, the length of the bridging member 119, as measured by the distance between the inner flap 114 and the forked panel 117, must be substantially equal to the distance between the center line of the slot 116 in each outer flap 113 and the adjacent fold line 115 about the inner flap 114.

Except as otherwise stated above, the shape and size of the bridging member 119 of this application are not considered critical. In fact the bridging member can have any configuration which does not interfere with the formation of a partition 130 from the forked panel 117 and the panel 111. Preferably, the bridging member 119 is substantially rectangular, having a width, as measured along bridging member fold lines 120 and 121, equal to or less than, preferably equal to, the width of the inner flap 114. In the especially preferred blank 110 of this application, bridging member 119 is substantially square and both the distance between bridging member fold lines 120 and 121 and the lengths of bridging member fold lines 120 and 121 equal the distance between each fold line 115 about the inner flap 114 and the center line of the slot 116 in the adjacent outer flap 113. In the particularly preferred blank 110, bridging member 119 is square, and the distances between each of the two fold lines 115 about the inner flap 114 and the center line of the slot 116 in the adjacent outer flap 113 equal the distance between the two fold lines 115 about the inner flap 114. As a result, the lengths of the bridging member fold lines 120 and 121 and the distance between them each equals the width of the one middle flap 114, to which the bridging member 119 is connected.

In blank 110, the widths of the three flaps 113, 113 and 114, as measured transverse of the fold lines 115 in panel 111, are not critical. However, the widths of the outer flaps 113 are preferably equal. It is especially preferred that the outer flaps 113, which contain the slots 116, be twice as wide as the inner flap 114 and that the slots 116 be located in the width-wise middle of the outer flaps 113. In this way, a partition 130 can be formed having substantially square cells formed by the flaps 113 and 114 and the forked panel 117 of the blank 110.

Also in blank 110, the lengths of the flap slots 116 and forked panel slots 118 are not critical. However, the combined length of a flap slot 116 and a forked panel slot 118 should be about equal to the width of the shorter of: the forked panel 117, as measured between the opposite forked panel sides 117' and 117''; and the panel 111, as measured between its opposite sides 111' and 111''. Preferably, the length of each flap slot 116 and forked panel slot 118 is about equal to one-half of the width of the forked panel 117, between its opposite sides 117' and 117''.

As seen from the foregoing, the blank 110 of this application basically comprises: a panel 111 having a set 112 of two substantially rectangular flaps 113 and 114 arranged in a row; the flaps 113 and 114 of the panel 111 being foldably connected along a fold line 115 between the flaps 113 and 114; a continuous slot 116 being provided in an outer flap 113 of the set 112 of flaps 113 and 114 of the panel 111, extending from one side 111' of the set of flaps and parallel to the fold line 115; a bridging member 119, one side of which is foldably connected only to an inner flap 114 (along fold line 120) of the set 112 of flaps 113 and 114 along the one slotted side 111' of the set of flaps; and a forked panel 117, foldably connected to the opposite side of the bridging member 119 (along fold line 121), remote from the one slotted side 111' of the set 112 of flaps 113 and 114, and having a continuous slot 118 extending from a side 117' thereof remote from the one slotted side 111' of the set of flaps; the center line of the slot 118 in the forked panel 117 being substantially colinear with the fold line 115 between the inner and outer flaps 113 and 114 of the set 112 of flaps, and the length of the bridging member 119, between the forked panel 117 and the inner flap 114, being about equal to the distance between the center line of the slot 116 in the outer flap 113 and the adjacent fold line 115 between the inner and outer flaps 113 and 114 in the set 112 of flaps in the panel 111.

Shown in FIG. 8 is the assembled partition 130, formed by folding the blank 110 through steps such as are shown in FIGS. 2 and 3 for forming partition 30. As folded about fold lines 115, the inner and outer flaps 113, 113 and 114 in the partition form a U-shaped construction. In this U-shaped construction, the outer flaps 113 are perpendicular to the inner flap 114. Also in this U-shaped construction, the inner flap 114 and the outer flaps 113 are perpendicular to the plane defined by the slotted side 111' of panel 111, as folded, and, hence, respectively comprise an upstanding, substantially rectangular side wall flap 114 and upstanding, substantially rectangular flaps 113. Also in partition 130, the forked panel 117, as folded about bridging member fold lines 120 and 121, is perpendicular to the plane formed by the one slotted side 111′ of panel 111, as folded. As a result, the center lines of the flap slots 116 and forked panel slots 118 are perpendicular to the plane defined by the one slotted panel side 111′, and the center line of each flap slot 116 is substantially colinear with the center line of a forked panel slot 118. Further in partition 130, the forked panel 117 is substantially transverse to the flaps 113 and parallel to the side wall flap 114, and bridging member 119 is substantially horizontal and coplanar with the one slotted panel side 111′.

As erected from the blank 110, the partition 130 of FIG. 8 basically comprises: an upstanding forked panel 117, having a vertical continuous slot 118 extending from the top side 117′ thereof; an upstanding, substantially rectangular flap 113, having a vertical continuous slot 116 extending from the bottom side 111′ thereof; an upstanding, substantially rectangular side wall flap 114, foldably connected to an upstanding side (along fold line 115) of the flap 113; and a bridging member 119, foldably connected to the bottom side 111′ of the side wall flap 114 and to the bottom side 117′ of the forked panel 117; the flap 113 being transverse to the forked panel 117 and the center lines of the slots 116 and 118 in the flap 113 and in the forked panel 117 being substantially colinear.

The substantially rectangular panels in the blanks for the partitions of this invention can consist of: one set 12 of two substantially rectangular flaps (i.e., an inner flap 14 and an outer flap 13); one set 12 of three substantially rectangular flaps (i.e., an inner flap 114 and two outer flaps 113); or more than one set (e.g., two to five sets) of three substantially rectangular flaps (i.e., an inner and two outer flaps).

In accordance with this application, where the partition blanks include substantially rectangular panels consisting of more than one set of three flaps, the outer flaps of each set are foldably attached to the outer flaps of other sets of flaps, and all the sets of flaps are arranged in a row. Also in these partition blanks, the two outer flaps in each set of three flaps include slots extending from the same side of the set of flaps. Further, a plurality of forked panels containing at least one slot or a single forked panel containing more than two slots are utilized in such blanks for partitions.

Figure 9:
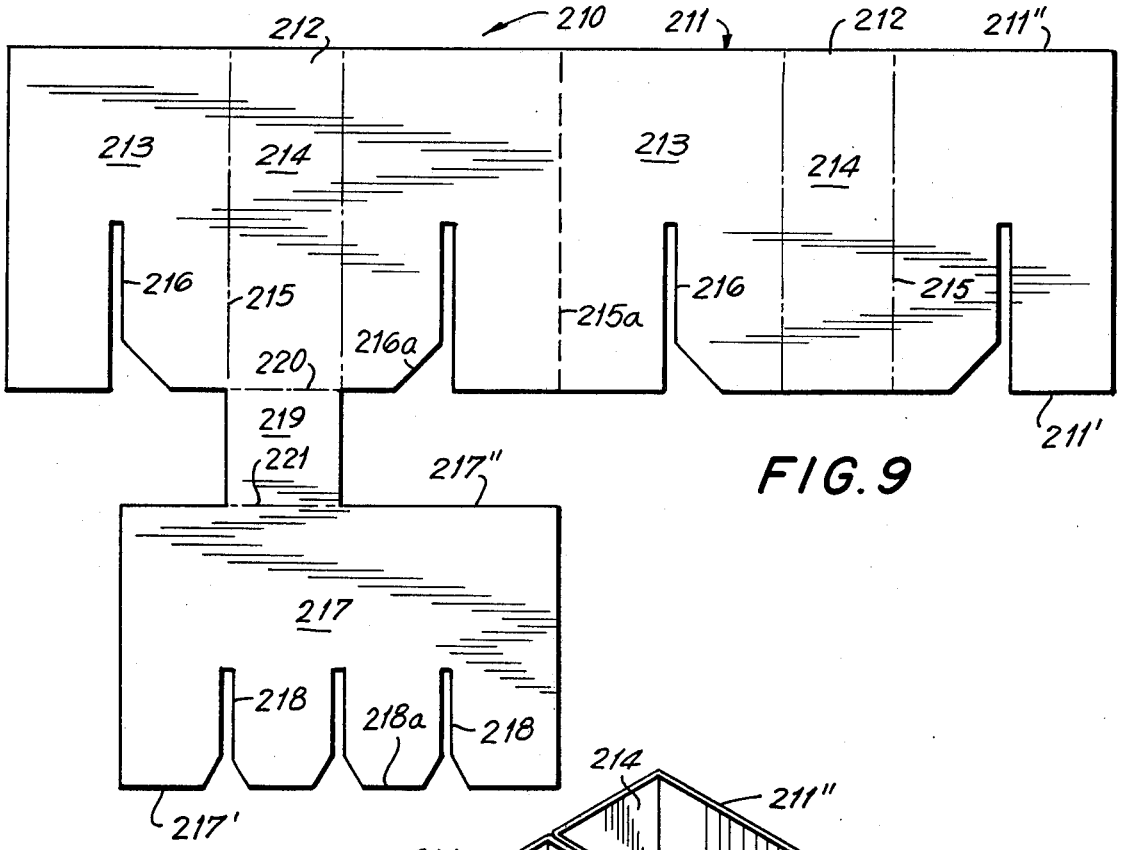
FIG. 9 is a plan view of a paperboard blank, in accordance with a second alternative embodiment of this invention, for forming an eight-cell partition.

An example of a partition blank, generally 210, of this invention which includes more than one set of three substantially rectangular flaps in a substantially rectangular panel and more than two slots in a single forked panel is shown in FIG. 9. The blank 210 is adapted to be folded into a one-piece, eight-cell partition, generally 230, shown in FIG. 12. The blank 210 and the partition 230 are alternative embodiments of this invention and include elements corresponding in function and configuration to elements of the blanks 10 and 110 of FIGS. 1 and 7 and partitions 30 and 130 of FIGS. 4 and 8. Hence, in describing this invention, elements of the blank 210 and partition 230 will have reference numerals which differ by 200 from the corresponding elements of the flank 10 and partition 30.

As seen from FIG. 9, the blank 210 includes a substantially rectangular panel, generally 211. The panel 211 consists of two foldably connected sets 212 of three foldably connected, substantially rectangular flaps 213, 213 and 214. The sets 212 of flaps 213, 213 and 214 and the three flaps in each set are arranged in a row. Each set 212 consists of two outer flaps 213 and an inner flap 214. The sets 212 of three flaps and the flaps themselves are foldably connected along substantially parallel fold lines 215. Preferably, the parallel fold lines 215 are scored fold lines. It is particularly preferred that one of the fold lines 215a, between the two sets 212 of flaps, be a perforated fold line. The lengths of the flaps, as measured along the parallel fold lines 215, are approximately equal. However, the widths of the flaps can differ in a manner which will hereinafter be discussed.

Provided in each of the outer flaps 213 and preferably not provided in the inner flaps 214 of the sets 212 is a continuous slot 216. Each slot 216 in the outer flap 213 of a set 212 extends from one side or edge of the panel 211 and from one side or edge of its set 212 of flaps 213, 213 and 214. In blank 210, the slots 216 in the sets 212 of flaps extend from a common slotted side 211′ of panel 211. The slots 216 in the sets 212 are substantially parallel to the fold lines 215 and to each other. The width of the slots 216 preferably is equal to or greater than the thickness of the blank 210. In this regard, it is especially preferred that the width of each slot 216 at the one slotted side 211′ of the panel 211 be much larger than the width of the remainder of the slot. For this purpose, angle-cut notches 216*a* are cut into the one slotted side 211′ of panel 211. Each notch 216*a* intersects one of the slots 216 and preferably is located between the one slot 216 and an adjacent inner flap 214.

The blank 210 also includes a substantially rectangular, forked panel 217. The forked panel 217 has a plurality of substantially parallel, continuous slots 218 extending from one side or edge 217′ of the forked panel 217 remote from the one slotted side 211′ of the panel 211. The width of the forked panel slots 218 preferably is equal to or greater than the thickness of the blank 210. In this regard, it is especially preferred that the width of each forked panel slot 218 along the one slotted side 217′ of the forked panel 217 be much larger than the width of the remainder of the slot 218. For this purpose, notches 218*a* are cut into the one slotted side 217′ of the forked panel 217 about the center lines of the forked panel slots 218.

In the blanks of this application, such as blank 210, provided with more than one set of three substantially rectangular flaps in a substantially rectangular panel and only one forked panel, the forked panel includes at least $(n + 1)$ continuous slots, preferably only $(n + 1)$ slots, wherein $n$ is the number of sets of three flaps in the panel. For example, where two to five sets of flaps are provided in the panel, at the minimum, three to six slots are provided in the single forked panel. Hence, as seen in FIG. 9, three slots 218 are provided in forked panel 217 of blank 210, containing two sets 212 of three flaps in panel 211.

The blank 210 further includes a bridging member 219. One side of the bridging member 219 is foldably connected along a first fold line 220 to the panel 211 and to an inner flap 114 of a set 212 of three flaps in the panel. The opposite side of the bridging member 219 is foldably connected to the forked panel 217 along a second fold line 221. Fold lines 220 and 221 are substantially parallel and are preferably scored fold lines. The bridging member 219 is foldably connected to the panel 211 and to the inner flap 214 along the one slotted side 211′ of the panel 211 and the one set 212 of flaps 213 and 214 to which the bridging member is connected. The bridging member 219 is foldably connected to the forked panel 217 along a second side 217'' of the forked panel 217. The second forked panel side 217'' is the side of the forked panel 217 located: closest to the one slotted side 211' of the panel 211 and the one set 212 of flaps; and on the opposite side of the forked panel 217 from the one slotted forked panel side 217'.

In blank 210 of this application, it is considered essential that the center lines of two slots 218, preferably adjacent slots 218, in the forked panel 217 be aligned with the fold lines 215, in the panel 211, about the one inner flap 214 to which the bridging member 219 is attached along the first bridging member fold line 220. It is also considered essential in blank 210 that the first bridging member fold line 220 be located between the two adjacent fold lines 215 in panel 211 about the one inner flap 214 to which the bridging member 219 is connected. Hence, in FIG. 9, the first bridging member fold line 220 is between the two fold lines 215 about the one inner flap 214 in panel 211 and between the center lines of two slots 218 in forked panel 217. However, the location and length of the first bridging member fold line 220 are otherwise not critical. In fact, the first bridging member fold line 220 can suitably be located anywhere between the two fold lines 215 about the one inner flap 214 and can suitably have a length equal to or less than the width of the one inner flap 214, i.e., the distance between the two fold lines 215. Preferably, the length of the first bridging member fold line 220 equals the width of the one inner flap 214.

Also in blank 210, the second bridging member fold line 221, connecting bridging member 219 and forked panel 217, is located along the second forked panel side 217'' and between the two fold lines 215, about the one inner flap 214 to which the bridging member 219 is connected. However, the location and length of the second bridging member fold line 221 are not critical. In fact, the second bridging member fold line 221 can suitably lie anywhere along the second forked panel side 217'' and have a length that is less than, equal to, or greater than the length of the first bridging member fold line 220. Preferably, the second bridging member fold line 221 has about the same length as the first bridging member fold line 220.

Further in blank 210, the length of the bridging member 219, as measured by the distance between the one inner flap 214, to which it is attached, and the forked panel 217, must be substantially equal to the distance between the center line of the slot 216 in each outer flap 213 and the adjacent fold line 215 about the one inner flap 214 in the set 212 of three flaps 213, 213 and 214 to which the bridging member 219 is attached.

Except as otherwise stated above, the shape and size of the bridging member 219 of this application are not considered critical. In fact the bridging member can have any configuration which does not interfere with the formation of a partition 230 from the forked panel 217 and the panel 211. Preferably, the bridging member 219 is substantially rectangular, having a width, as measured along bridging member fold lines 220 and 221, equal to or less than, preferably equal to, the width of the one inner flap 214 to which it is attached. In the especially preferred blank 210 of this application, bridging member 219 is substantially square, and both the distance between bridging member fold lines 220 and 221 and the lengths of bridging member fold lines 220 and 221 equal the distance between a fold line 215 about the one inner flap 214 and the center line of a slot 216 in the adjacent outer flap 213 in the set 212 of three flaps to which the bridging member 219 is connected. In the particularly preferred blank 210, bridging member 219 is square, and the distances between each of the two fold lines 215 about the one inner flap 214 and the center line of the slot 216 in the adjacent outer flap 213 equal the distance between the two fold lines 215 about the one inner flap 214. As a result, the lengths of the bridging member fold lines 220 and 221 and the distance between them equal the width of the one inner flap 214 to which the bridging member 219 is connected.

In blank 210, the widths of the three flaps 213, 213 and 214 in each set 212, as measured between the fold lines 215 in panel 211, are not critical. However, the widths of all the outer flaps 213 in all the sets 212 are preferably equal, and the widths of all the inner flaps 214 in all the sets 212 are preferably equal. It is especially preferred that the outer flaps 213, which contain the slots 216, be twice as wide as the inner flaps 214 and that the slots 216 be located in the width-wise middle of the outer flaps 213. In this way, a partition 230 can be formed having substantially square cells formed by the flaps 213 and 214 and the forked panel 217 of the blank 210.

Also in blank 210, the lengths of the flap slots 216 and forked panel slots 218 are not critical. However, the combined lengths of a flap slot 216 and a forked panel slot 218 should be about equal to the width of the shorter of: the forked panel 217, as measured between the opposite forked panel sides 217' and 217''; and the panel 211, as measured between its opposite sides 211' and 211''. Preferably, the length of each flap slot 216 and forked panel slot 218 is about equal to one-half of the width of the forked panel 217, between its opposite sides 217' and 217''.

In blank 210, the number of sets 212 of three rectangular flaps 213, 213 and 214 and the number of corresponding forked panel slots 218 are not critical. In fact, blank 210 can be expanded to include, for example, ten sets of three flaps and eleven forked panel slots. Also in blank 210, particular shapes of the panel 211, flaps 213 and 214 and the forked panel 217 are not critical. However, at a minimum, the blank 210 of this application comprises: a panel 211 having a set 212 of two substantially rectangular flaps 213 and 214 arranged in a row; the flaps 213 and 214 of the panel 211 being foldably connected along a fold line 215 between the flaps; a continuous slot 216 being provided in an outer flap 213 of the set 212 of flaps 213 and 214, extending from one side 211' of the set of flaps and parallel to the fold line 215; a bridging member 219, one side of which is foldably connected only to the inner flap 214 (along fold line 220) of the set 212 of flaps 213 and 214 in the panel 211 along the one slotted side 211' of the set of flaps; and a forked panel 217, foldably connected to the opposite side of the bridging member 219 (along fold line 221), remote from the one slotted side 211' of the set 212 of flaps 213 and 214, and having a continuous slot 218 extending from a side 217' thereof remote from the one slotted side 211' of the set of flaps; the center line of the slot 218 in the forked panel 217 being substantially colinear with the fold line 215 between the inner and outer flaps 213 and 214 of the set 212 of flaps, and the length of the bridging member 219, between the forked panel 217 and the inner flap 214, being about equal to the distance between the outer line of the slot 216 in the outer flap 213 and the adjacent fold line 215 between the inner and outer flaps 213 and 214 in the set 212 of flaps in the panel 211.

Figure 10:
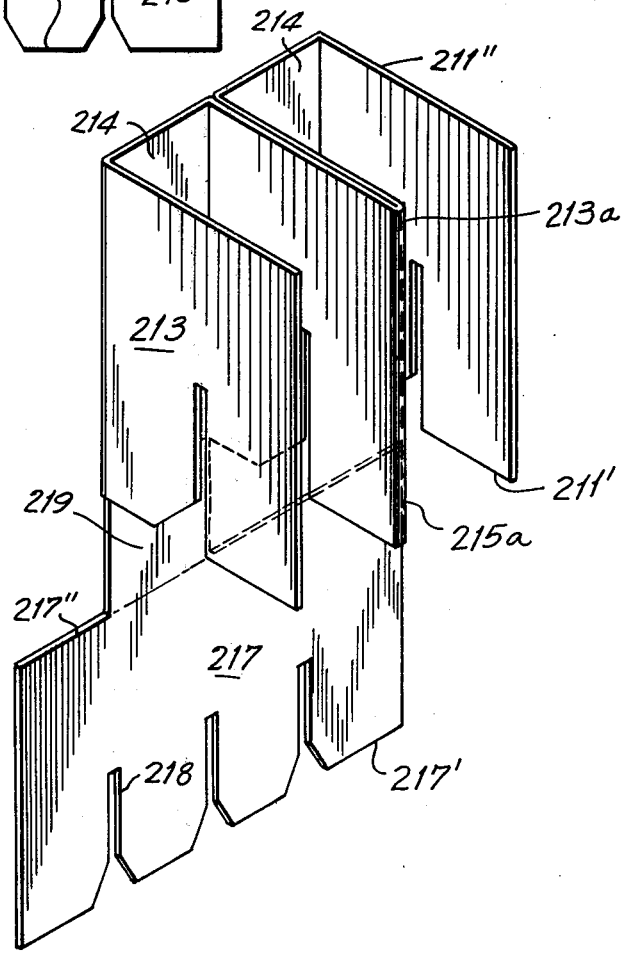
FIG. 10 is a perspective view of a partially assembled partition, formed from the blank of FIG. 9.

Shown in FIG. 10 is a first step in folding the blank 210 into the one-piece partition 230. In FIG. 10, the outer flaps 213 of each of the two sets 212 of flaps 213, 213 and 214 of the panel 211 have been folded about fold lines 215, on either side of inner flaps 214, to form two U-shaped constructions. In the U-shaped constructions, as seen in FIGS. 10–14, the outer flaps 213 are parallel to each other and perpendicular to the inner flaps 214, and the flap slots 216 are parallel and coplanar. Also in these U-shaped constructions, the connected outer flaps 213 of adjacent sets 212 of flaps, about perforated fold line 215*a*, are positioned in side-by-side relationship, to form a wall of double flap thickness 213*a*, and the inner flaps 214 of the sets 212 of flaps are substantially coplanar and adjacent. Further in these U-shaped constructions, the inner flaps 214 and the outer flaps 213 are perpendicular to the plane defined by the one slotted side 211′ of panel 211, as folded, and hence, respectively comprise upstanding, substantially rectangular side wall flaps 214 and upstanding, substantially rectangular flaps 213.

Figure 11:
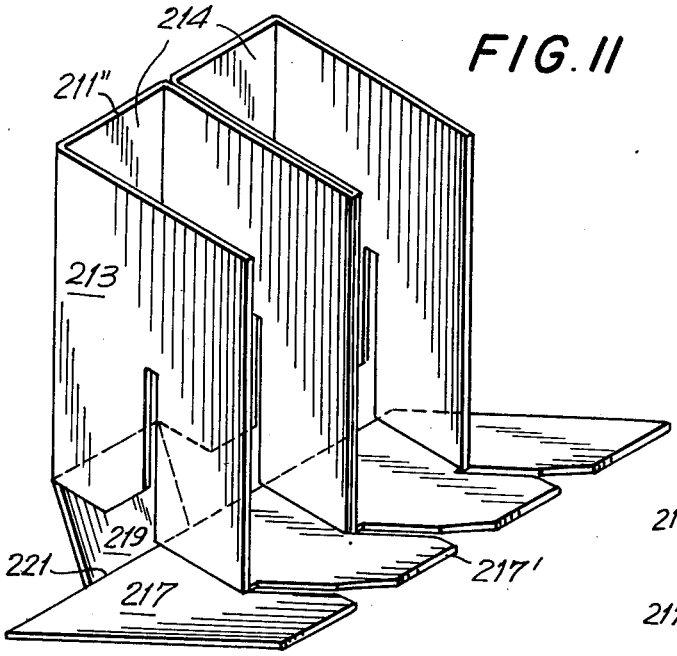
FIG. 11 is a perspective view of a partially assembled partition, formed from the partially assembled partition shown in FIG. 10.

Shown in FIG. 11 is a second step in folding the blank 210 to form the one-piece partition 230. As seen in FIG. 11, the bridging member 219 and the forked panel 217 have been folded somewhat about bridging member fold lines 220 and 221. As folded, each of the forked panel slots 218 is adjacent the slotted sides 211′ of the upstanding flaps 213.

Figure 12:
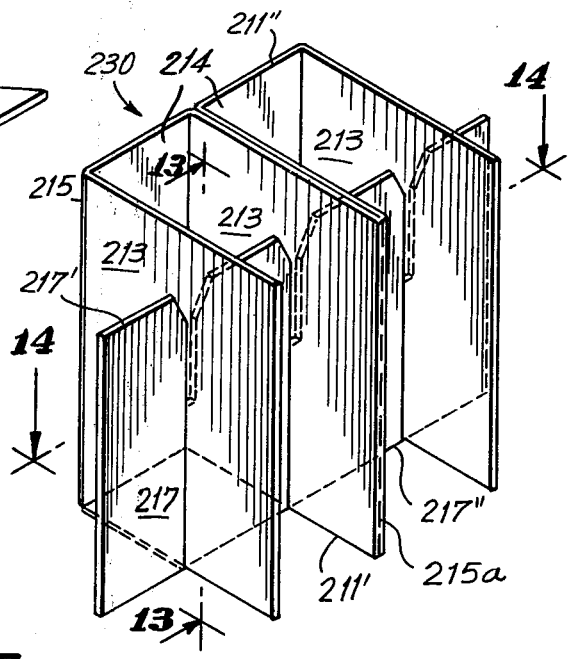
FIG. 12 is a perspective view of a fully assembled, eight-cell partition, in accordance with this invention, formed from the partially assembled partition of FIG. 11.

Shown in FIG. 12 is the assembled partition 230, formed from the blank 210, as folded through the steps shown in FIGS. 10 and 11. The partition 230 has been completed by folding the forked panel 217 and bridging member 219 further about bridging member fold lines 220 and 221. In the partition 230, the forked panel 217 is perpendicular to the plane formed by the one slotted side 211′ of panel 211, as folded. As a result, the center line of each forked panel slot 218 is colinear with the center line of a flap slot 216, and both the forked panel slots 218 and the flap slots 216 are perpendicular to the plane defined by the one slotted side 211′ of panel 211, as folded. Also in partition 230, the forked panel 217 is substantially transverse to the flaps 213 and parallel to the side wall flaps 214. Further in partition 230, bridging member 219 is substantially horizontal and coplanar with the one slotted panel side 211′.

The one-piece partitions of this application, such as partition 230 of FIG. 12, erected from the blank 210, can, if desired, include more than one, upstanding forked panel 217, more than one, upstanding set 212 of flaps 213, more than one, upstanding side wall flap 214, and more than one bridging member 219, connected to the bottom sides 217″ of the forked panels 217 and the bottom sides 211′ of the side wall flaps 214. However, at a minimum, the partition 230 comprises: an upstanding forked panel 217, having a vertical continuous slot 218 extending from the top side 217′ thereof; an upstanding, substantially rectangular flap 213, having a vertical continuous slot 216 extending from the bottom side 211′ thereof; an upstanding, substantially rectangular, side wall flap 214, foldably connected to an upstanding side (along fold line 215) of the flap 213; and a bridging member 219, foldably connected to the bottom side 211′ of the side wall flap 214 and to the bottom side 217″ of the forked panel 217; the flap 213 being transverse to the forked panel 217 and the center lines of the slots 216 and 218 in the flap 213 and in the forked panel 217 being substantially colinear.

As seen in FIGS. 4–6, 8 and 12–14, the preferred partitions 30, 130 and 230 of this application include a plurality of cells having at least four walls formed by the upstanding flaps 13, 113 and 213 and the upstanding forked panels 17, 117, and 217. Additional walls of the cells are formed by the side wall flaps 14, 114 and 214 and the bridging members 19, 119 and 219. Preferably, the walls (except walls 213*a*) of the cells of the partitions 30, 130 and 230 are formed from single thicknesses of the flaps and panels of the blanks 10, 110 and 210. Indeed, that the partitions 30, 130 and 230 can be suitably formed from such single thicknesses of flaps and panels is quite advantageous in minimizing the usage of paperboard. However, if desired, walls of multiple (e.g., three) flap thickness can be provided for the cells of partitions 30, 130 and 230. This can be done, for example, by the use of: additional flaps above the basic two or three flaps in each set, e.g., by using three (rather than one) foldably connected, adjacent outer flaps 13, 113 and 213, in a row, connected to an inner flap 14, 114 and 214, or by using three (rather than one), foldably connected, adjacent inner flaps 14, 114 and 214, in a row, connected to an outer flap 13, 113 and 213; or by the use of additional bridging members, in excess of the basic one, e.g., by using three (rather than one), foldably connected bridging members 19, 119 and 219, in a row, between the panels 11, 111 and 211 and the forked panels 17, 117 and 217.

As also seen in FIGS. 4–6, 8 and 12–14, the cells in the partitions 30, 130 and 230 are substantially square and of equal size. However, if desired, the relative widths of the outer and inner flaps 13, 14, 113, 114, 213 and 214 in each set 12, 112 and 212 of panels 11, 111 and 211 and the location of the slots 16, 116 and 216 in the outer flaps 13, 113 and 213 can be varied to provide rectangular cells rather than square cells and/or cells of varying sizes in the partitions 30, 130 and 230 of this application.

In accordance with this application, the basic set 12 of two flaps 13 and 14 having one slot 16 and the basic forked panel 17 having one slot 18, in blank 10, form a partition 30 with four cells or divisions in it; and the basic set 112 of three flaps 113, 113 and 114 having two slots 116 and the corresponding forked panel 117 having two slots 118, in blank 110, form a partition 130 having six cells in it. Each additional set 212 of three flaps 213, 213 and 214, as in blank 210, in combination with additional slots 218 in a forked panel 217 or additional slotted forked panels, provides an additional four cells in the resulting partition 230.

Figure 13:
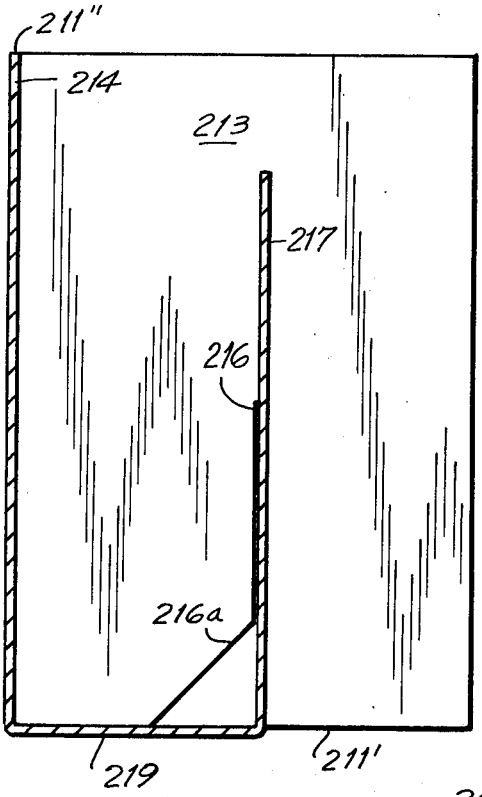
FIG. 13 is a sectional view taken along line 13—13 in FIG. 12.
Figure 14:
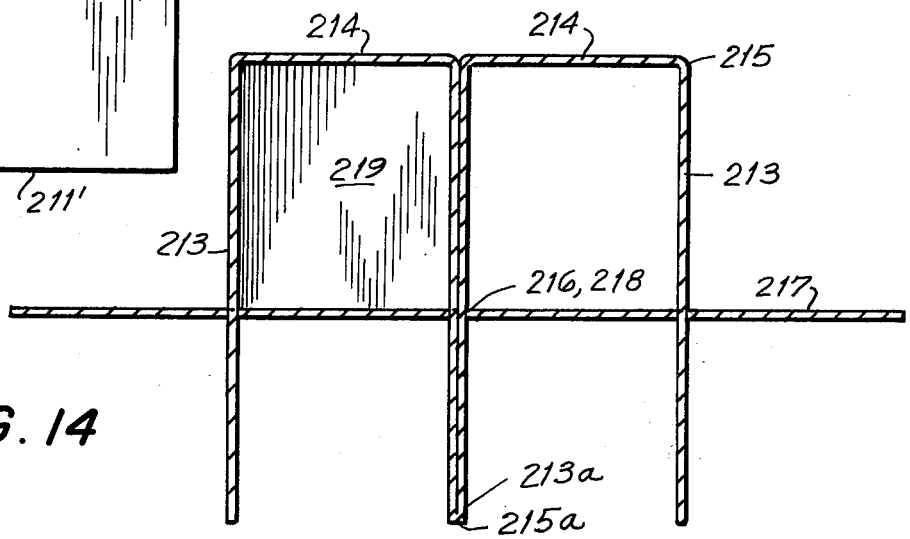
FIG. 14 is a sectional view taken along line 14—14 in FIG. 12.

The partition 230 shown in the FIGS. 12–14 can be expanded to include greater numbers of cells by utilizing, in its blank 210, additional sets 212 of three flaps 213, 213 and 214, provided with slots 216 in the one slotted panel side 211′, and a singled forked panel 217 containing at least $(n+1)$ slots 218. However, in blank 210, an outer flap 213 of each additional set 212 of three flaps 213, 213 and 214 must be foldably connected, preferably along a perforated fold line 215*a*, to the outer flap 213 of another set 212 of flaps. Also, in blank 210, the width of certain slots 218 in the forked panel 217 should be widened to accommodate double flap thicknesses 213a which occur where adjacent outer flaps 213 of adjacent sets 212 of three flaps are disposed in side-by-side relation. Further, it is important that the slots 216 in the outer flaps 213 of each additional set 212 be spaced from the pair of fold lines 215 about the inner flap 214 of the same additional set by the same distance as the slots 216 in the outer flaps 213 of the basic set 212 of three flaps are spaced from the pair of fold lines 215 about the inner flap 214 in the basic set 212.

Also in accordance with this application, partition 230 can be expanded to include greater numbers of cells by using, in blank 210, additional forked panels 217 (not shown) containing at least one slot 218 in combination with additional sets 212 of three flaps. Preferably, where the blank 210 has no more than three sets 212 of three flaps, the use of a single forked panel 217 containing up to four slots 218 is preferred. However, where more than three sets 212 of flaps 213 and 214 are utilized, the use of more than one forked panel 217 is often preferred.

The spacing of the additional forked panel slots 218 in a single forked panel 217, when additional sets 212 of three flaps 213, 213 and 214 are provided in blank 210, is not critical. Preferably, where all the inner flaps 214 of the sets 212 of flaps in panel 211 are of the same width, the distances between the center lines of all the forked panel slots 218 are the same.

In utilizing an additional forked panel 217, one or more slots 218 are provided along one forked panel slotted side 217′ thereof, remote from the one slotted side 211′ of the set 212 of flaps to which the additional forked panel 217 is connected. Each additional forked panel is connected to the inner flap 214 of an additional set 212 of flaps with an additional bridging member 219. The additional forked panel 217 is connected to the additional bridging member along its second forked panel side 217″, on the oppsite side of the additional forked panel from its one slotted side 217′. Additional bridging members 219 can be connected to the inner flap 214 of each additional set 212 or can be connected to the inner flaps of more widely spaced additional sets in panel 211.

When employing additional bridging members 219, all the bridging members 219 can be connected to the panel 211 along a single slotted side 211′. Alternatively, some or all of the additional bridging members can be connected to the oppostie side 211″ of panel 211, where both sides 211′ and 211″ of the panel 211 are slotted. The selection of the panel side for connecting an additional bridging member 219 and forked panel 217 to an additional set 212 of flaps 213 and 214 in panel 211 depends only upon where the slots 216 are provided in the outer flaps 213 of the additional set 212 of flaps. Each additional bridging member 219, where utilized, is provided on the side of an additional set 212 of flaps in panel 211 from which the slots 216 extend in the outer flaps 213 of the additional set. Preferably, all the slots 216 extend from a single slotted side 211′ of the panel 211, and, hence, all the bridging members 219 can be connected to the panel 211 along a single slotted side 211′.

In the paperboard blanks 10, 110 and 210 and partitions 30, 130 and 230 of this application, the panels 11, 111 and 211 and their flaps 13, 14, 113, 114, 213 and 214, and the forked panels 17, 117 and 217 have been described and shown as substantially rectangular. However, in accordance with this invention, the configurations of these flaps and panels, particularly of the forked panels, can be varied widely. For example, various cut-outs may be made in the sides or edges of these flaps and panels, thereby giving them significantly different polygonal configurations, without substantially interfering with: the strength and rigidity of the resulting partitions 30, 130 and 230 of this application; their usefulness for separating containers, particularly filled containers, in a packing carton; their ease of assembly by a single workman; or the relatively small requirement of paperboard material for their construction. Thus, the "substantially rectangular" panels, "substantially rectangular" flaps, and "substantially rectangular" forked panels of this application encompass a wide variety of equivalent polygonal configurations, including elliptical configurations, for such panels and flaps, besides their preferred rectangular configurations.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the forms hereinbefore described merely preferred embodiments thereof.

I claim:

1. A blank for a one-piece partition, which comprises:

a panel having a set of two substantially rectangular flaps arranged in a row; said flaps of said panel being foldably connected along a fold line between said flaps;

a continuous slot being provided in the width-wise middle of an outer flap of said set of flaps of said panel, extending from one side of said set of flaps and parallel to said fold line;

a bridging member, one side of which is foldably connected only to an inner flap of said set of flaps along said one slotted side of said set of flaps; and a forked panel, foldably connected to the opposite side of said bridging member, remote from said one slotted side of said set of flaps, and having a continuous slot extending from a side thereof remote from said one slotted side of said set of flaps;

the center line of said slot in said forked panel being substantially colinear with said fold line between said inner and outer flaps of said set of flaps, and the length of said bridging member, between said forked panel and said inner flap, being about equal to the distance between the center line of said slot in said outer flap and the adjacent fold line between said inner and outer flaps in said set of flaps in said panel.

2. The blank of claim 1 wherein said panel includes only two flaps.

3. The blank of claim 2 wherein said forked panel includes only one of said slots.

4. The blank of claim 1 wherein said panel includes one or more foldably connected sets, arranged in a row, of three flaps; each set comprising one of said inner flaps and two of said outer flaps, foldably connected along two of said fold lines, about said inner flap; and said forked panel having at least two of said slots; the center lines of two of said slots in said forked panel being substantially colinear with said fold lines about said inner flap of one of said sets of three flaps.

5. The blank of claim 4 wherein said forked panel includes $(n + 1)$ of said slots, in which n is the number of said sets of three flaps.

6. The bank of claim 5 wherein said panel includes two or more sets of three flaps and the distances between the center lines of said slots in said forked panel are the same.

7. The blank of claim 4 wherein said panel includes only three flaps in each of said sets.

8. The blank of claim 7 wherein said panel includes two of said sets of three flaps and said forked panel includes three of said slots.

9. the blank of claim 1 wherein said panel and said flaps are rectangular.

10. The blank of claim 9 wherein said forked panel is rectangular.

11. The blank of claim 10 wherein said bridging member is rectangular.

12. The blank of claim 11 wherein said bridging member is square.

13. The blank of claim 1 wherein the width of said slot in said outer flap at the one slotted side of said set of flaps is much larger than the width of the remainder of said slot.

14. The blank of claim 13 wherein an angle-cut notch is cut into said one slotted side of said set of flaps, said notch intersecting said slot in said outer flap of said set of flaps and being located between said slot and said inner flap.

15. The blank of claim 13 wherein the width of said slot in said forked panel at said one slotted side thereof is much larger than the width of the remainder of said slot.

16. The blank of claim 15 wherein a notch is cut into said one slotted side of said forked panel about the center line of said slot in said forked panel.

17. The blank of claim 1 wherein said bridging member is connected to said inner flap along a fold line having a length equal to the width of said inner flap, as measured by the distance transverse of said fold line between said inner and outer flaps.

18. The blank of claim 4 wherein a plurality of said sets of three flaps are provided in said blank and the widths of said outer flaps of said sets are equal and the widths of said inner flaps of said sets are equal.

19. The blank of claim 18 wherein the outer flaps of said sets are twice as wide as the inner flaps of said sets and said slots in said outer flaps are located in the width-wise middle of said outer flaps.

20. A one-piece partition, which comprises:

an upstanding forked panel, having in the width-wise middle thereof a vertical continuous slot extending from the top side thereof;

an upstanding, substantially rectangular flap, having a vertical continuous slot extending from the bottom side thereof;

an upstanding, substantially rectangular side wall flap, foldably connected to an upstanding side of said flap; and a bridging member, foldably connected to the bottom side of said side wall flap and to the bottom side of said forked panel;

said flap being transverse to said forked panel and the center lines of said slots in said flap and in said forked panel being substantially colinear.

21. The partition of claim 20 wherein said partition includes only one of said upstanding flaps and only one of said upstanding side wall flaps.

22. The partition of claim 21 wherein said forked panel includes only one of said slots.

23. The partition of claim 20 wherein said partition includes two or more of said flaps, transverse to said forked panel; and said forked panel includes two or more of said slots; the center lines of said slots in said flaps being substantially colinear with said slots in said forked panel.

24. The partition of claim 23 which includes more than two of said flaps and more than two of said slots in said forked panel; two of said flaps being foldably connected and arranged in side-by-side relationship.

25. The partition of claim 20 wherein said flaps and said forked panel are rectangular.

26. The partition of claim 20 wherein said bridging member is connected to said side wall flap along a fold line having a length equal to the width of said side wall flap, as measured along the bottom of said side wall flap.

27. The partition of claim 20 wherein a plurality of said flaps and a plurality of said side wall flaps are provided and the widths of said flaps are equal and the widths of said side wall flaps are equal; said widths being measured along the bottom of said flaps and said side wall flaps.

28. The partition of claim 27 wherein said flaps are twice as wide as said side wall flaps and said slots in said flaps are located in the width-wise middle of said flaps.

* * * * *

UNITED STATES PATENT AND TRADEMARK OFFICE

CERTIFICATE OF CORRECTION

PATENT NO. : 4,000,844

DATED : January 4, 1977

INVENTOR(S) : Charles P. Weimer, Jr.

It is certified that error appears in the above-identified patent and that said Letters Patent are hereby corrected as shown below:

at column 5, line 52, "tansverse" should be -- transverse -- ;

at column 9, line 61, "200" should be -- two hundred (200) -- ;

at column 18, lines 1-2, "in the width-wise middle thereof" should be deleted; and at column 18, line 4, after "having", should be inserted -- in the width-wise middle thereof -- .

Signed and Sealed this

Thirty-first Day of May 1977

[SEAL]

*Attest:*

RUTH C. MASON
*Attesting Officer*

C. MARSHALL DANN
*Commissioner of Patents and Trademarks*